US005564944A

United States Patent [19]

Fukuda

[11] Patent Number: 5,564,944

[45] Date of Patent: Oct. 15, 1996

[54] DRIPPROOF CONNECTOR

[75] Inventor: Masaru Fukuda, Shizuoka, Japan

[73] Assignee: Yazaki Corporation, Tokyo, Japan

[21] Appl. No.: 355,345

[22] Filed: Dec. 12, 1994

[30] Foreign Application Priority Data

Dec. 10, 1993 [JP] Japan ..... 5-340950

[51] Int. Cl.[6] ..... H01R 13/52

[52] U.S. Cl. ..... 439/521; 439/367; 439/456

[58] Field of Search ..... 439/521, 367, 439/142, 133, 134, 149, 372, 596, 374, 354, 456, 457

[56] References Cited

U.S. PATENT DOCUMENTS

| | | | |
|---|---|---|---|
| 4,229,616 | 10/1980 | Hotchkiss | 439/521 |
| 4,410,224 | 10/1983 | Giulie | 439/521 |
| 4,884,978 | 12/1989 | Inaba et al. | 439/354 |
| 5,000,690 | 3/1991 | Sonobe et al. | 439/354 |
| 5,080,608 | 1/1992 | Yarnton et al. | 439/457 |
| 5,256,072 | 10/1993 | Hatagishi | 439/521 |
| 5,368,500 | 11/1994 | Dedering | 439/367 |

FOREIGN PATENT DOCUMENTS 56-57486 5/1981 Japan .

*Primary Examiner*—Hien D. Vu

*Attorney, Agent, or Firm*—Sughrue, Mion, Zinn, Macpeak & Seas

[57] ABSTRACT

A female connector housing has male terminals attached thereto and is closed by a cover member, the cover member being allowed to be opened and closed. A male connector housing is inserted into an insertion portion of the female connector housing, so that female terminals are attached to the male terminals. The insertion portion of the female connector housing is opened in such a direction as to face downward when installed. Both the female connector housing and the male connector housing have outlets for holding the electrical cables connected to the male and female terminals on a side that faces downward when installed. Since a connector is opened only at a lower portion thereof, waterdrops falling down from above can in no way enter into the connector.

4 Claims, 3 Drawing Sheets

DRIPPROOF CONNECTOR

BACKGROUND OF THE INVENTION

The present invention relates to a dripproof connector for use in the room of an automobile and, more particularly, to a dripproof connector structure that maintains watertightness without using any packing or rubber.

When the interior of an automobile is dehumidified or cooled by an air conditioner, air vents in the interior of the automobile sometimes become covered with water due to condensation and such water sequentially drops. When a connector for connecting electrical cables is disposed at a place on which waterdrops fall down, the connector is wetted by these waterdrops. If the waterdrops enter into the connector, electric corrosion occurs between the connection terminals, which damages the terminals.

To overcome problems of this type, a connector is disclosed in Japanese Unexamined Utility Model Publication No. Sho. 56-57486. FIG. 6 is an exploded perspective view of this connector; and FIG. 7 is a sectional view thereof. This connector is formed of a male connector 59 and a female connector 61, each having a plurality of terminal accommodating chambers 55, 57 for accommodating connection terminals 51, 53 interposing an appropriate space S therebetween. The female connector 61 has an insertion groove 65 formed in a frame 63 enclosing the terminal accommodating chambers 55 at a front half portion of the terminal accommodating chambers 55, and a waterdrop discharging hole 67 is arranged in the bottom of the groove. On the other hand, the male connector housing 59 has an insertion frame 69 at a front opening end of the terminal accommodating chambers 57, the insertion frame corresponding to the insertion groove 65.

As a result of this construction, even if waterdrops deposit on the inside of the connector, the waterdrops can be discharged swiftly from the discharge hole 67, thus preventing electric corrosion due to leakage of current at the contacts between the connection terminals.

However, although this construction is advantageous in discharging dews formed inside the connector, no measure against water entering into the connector along electrical cables 71, 73 is provided. As a result, it is likely that waterdrops will reach the contacts along the electrical cables 71, 73, thus imposing a problem of inadequate reliability in preventing electric corrosion.

SUMMARY OF THE INVENTION

The present invention has been made in consideration of the aforementioned problem and an object of the invention is, therefore, to provide a dripproof connector of such a construction as not to allow waterdrops to come in contact with the connection terminals even if the waterdrops fall down on the connector.

The above object of the invention is achieved by the following construction.

(1) A dripproof connector that includes: a female connector housing having an insertion portion in which one of a male terminal and a female terminal is disposed and being allowed to be closed by a cover member which can be opened and closed; and a male connector housing being inserted into the female connector housing and accommodating the other terminal. In such connector, the insertion portion of the female connector housing has an opening on a side facing downward when installed; and both the female connector housing and the male connector housing have outlets for electrical cables being connected to the terminals on a side facing downward when installed.

(2) A dripproof connector according to the above item (1), wherein the outlet of the female connector housing is opened in the same direction as the insertion portion, and the electrical cable is arranged so as to be U-shaped inside the female connector housing.

In the invention, the electrical cable outlets of the connector are only required to face downward when installed. That is, the direction in which these outlets face is not limited to a perpendicularly downward direction. The direction may be an obliquely downward direction.

Moreover, it is preferable that the male connector housing insertion portion and the electrical cable outlet formed in the female connector housing have openings that face in the same direction. However, they may face in different directions as long as they face downward.

According to the invention, the female connector housing is closed by the cover member; the opening of the male connector housing insertion portion formed in the female connector housing faces downward when installed; and the electrical cable outlets formed in both the female connector housing and the male connector housing also face downward when installed. Thus, even if waterdrops fall down onto the connector, the waterdrops do not intrude into the connector. Therefore, even in a place where waterdrops are likely to fall down such as in a place under where condensation takes place as a result of air conditioning or the like within the interior of an automobile, the electrical cables can be connected in good watertightness over a long period of time. In addition, the connector is watertight without using other seal member, which makes the structure thereof uncomplicated. Hence, the connector of the invention can prevent deposition of waterdrops on the connection terminals with a simple structure.

DETAILED DESCRIPTION OF THE PREFERRED EMBODIMENTS

Preferred embodiments of the present invention will now be described with reference to the accompanying drawings.

Figure 1:
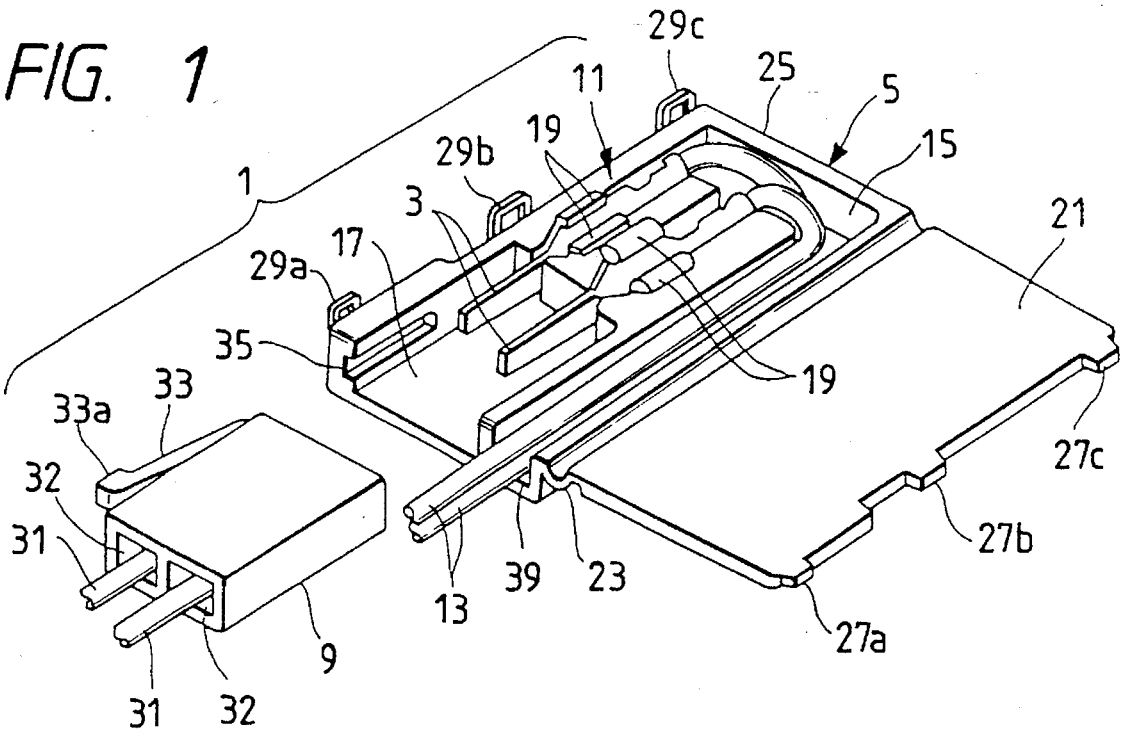
FIG. 1 is an exploded perspective view of a connector, which is a first embodiment of the invention, with a cover removed.
Figure 2:
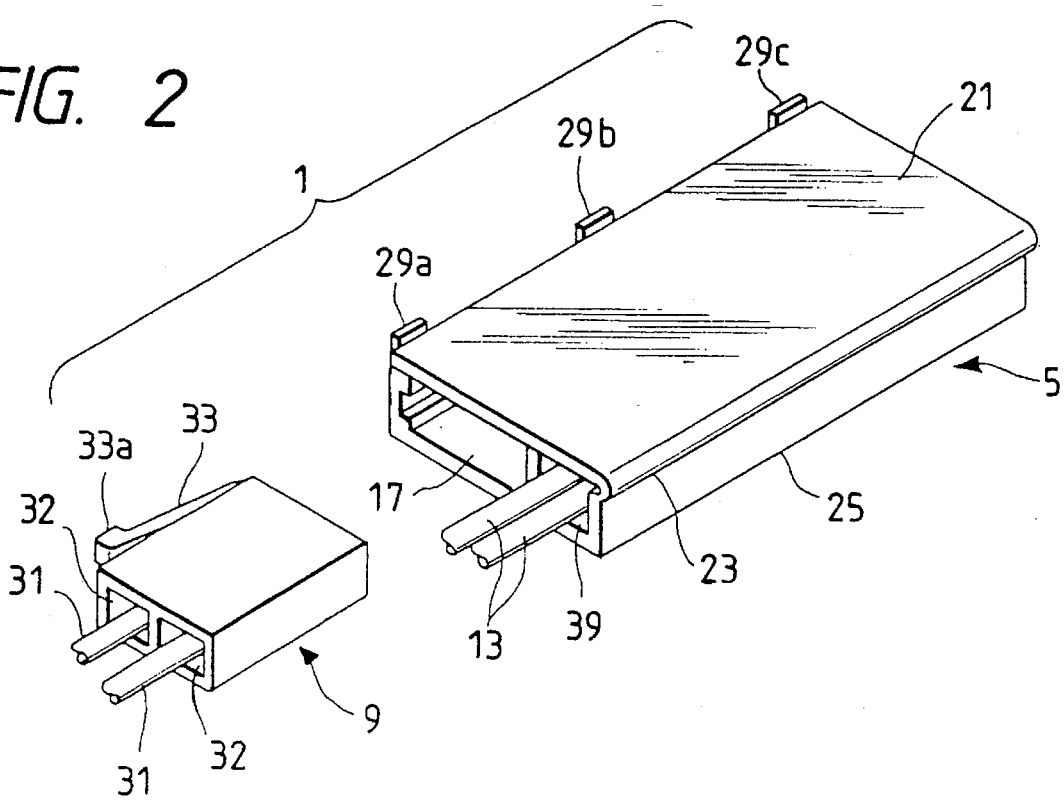
FIG. 2 is an exploded perspective view of the connector, which is the first embodiment, with the cover closed.
Figure 3:
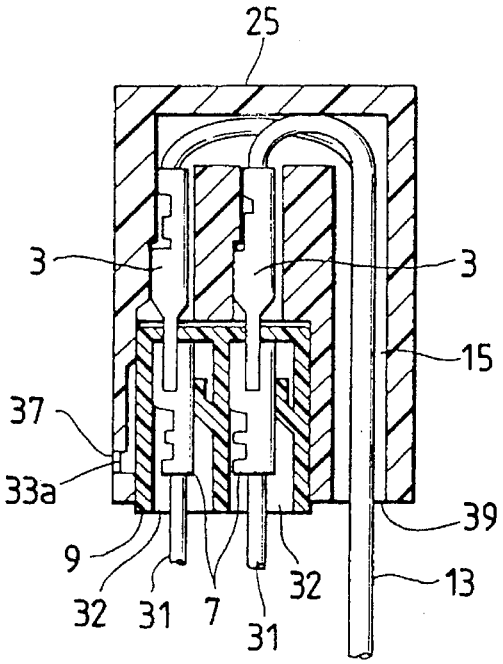
FIG. 3 is a partially sectional view of the connector of FIG. 1.

FIGS. 1 and 2 are exploded perspective views of a first embodiment of the invention; and FIG. 3 is a sectional view thereof.

A connector 1 includes a female electrical connector housing 5 into which a pair of male terminals 3 are inserted, and a male electrical connector housing 9 into which female terminals 7 are inserted. Both the female connector housing 5 and the male connector housing 9 are molded using a synthetic resin. The female connector housing 5 has a attachment portion 11 for the male terminal 3, an electrical cable accommodation portion 15 for accommodating electrical cables 13 connected to the male terminals 3, and an insertion portion 17 into which the male connector housing 9 is inserted, these components 11, 15, 17 being recesses, respectively. Fixing catches 19 for fixing the male terminals 3 are provided in the attachment portion 11 so as to protrude beyond the attachment portion so that the male terminals 3 connected to the electrical cables 13 are fixed to the attachment portion 11 while squeezed by the fixing catches 19. The tips of the pair of fixed male terminals 3 extend within the insertion portion 17 and are connectable to the female terminals 7, which will be described later.

Further, the female connector housing 5 has a cover member 21 formed integrally therewith. The cover member 21 covers the insertion portion 17, the male terminal attachment portion 11 and the electrical cable accommodation portion 15. The cover member 21 is molded integrally with a female connector housing main body 25 through a thinly formed hinge portion 23 so as to be pivotable with respect to the female connector housing main body 25. Retaining projections 27*a*, 27*b*, 27*c* formed on the cover member 21 are retained in retainment receiving portions 29*a*, 29*b*, 29*c* formed on the female connector housing main body 25, so that the outer periphery of the female connector housing main body 25 is brought into pressure contact with the cover member 21, thereby allowing the inside of the female connector housing 5, excluding the insertion portion 17 side, to be kept watertight. Therefore, the cover member 21 is formed into such a shape as to contact the female connector housing main body 25 without a gap therebetween. The cover member 21 is closed after the electrical cables 13 and the male terminals 3 that are connected to the electrical cables 13 have been attached to the female connector housing 5.

FIG. 3 is a sectional view showing the male connector housing 9 inserted into the insertion portion 17 of the female connector housing 5. As is apparent from FIG. 3, the female terminals 7 connected to the electrical cables 31 are attached to the male connector housing 9, and the electrical cables 31 extend outside from outlets 32 opened in the same direction as the insertion portion 17. By inserting the male connector housing 9 into the insertion portion 17 of the female connector housing 5, the male terminals 3 are connected to the female terminals 7. A flexible lock arm 33 is formed integrally with the male connector housing 9, whereas an engagement groove 35 engageable with the lock arm 33 is formed in the insertion portion 17 of the female connector housing 5. As a result of such locking construction, when the male connector housing 9 is properly inserted into the insertion portion 17 of the female connector housing 5, a distal end portion 33*a* of the lock arm 33 is retained in a retainment hole 37 within the engagement groove 35 to maintain the inserted condition. Hence, the connection between the male terminals 3 and the female terminals 7 is maintained satisfactorily. It should be noted that the male connector housing 9 is released from the female connector housing 5 by pulling the male connector housing 9 out while pushing the distal end portion 33*a* of the lock arm 33 inward from the outside of the retainment hole 37.

The electrical cables 13 connected to the male terminals 3 inside the female connector housing 5 are arranged so as to be U-shaped inside the female connector housing 5 and extend outside the female connector housing 5 from an electrical cable outlet 39 that is opened in the same direction as the insertion portion 17.

From the male connector housing 9 inserted into the female connector housing 5 extend the electrical cables 31 connected to the female terminals 7. These electrical cables 31 extend in the same direction as the electrical cables 13 coming out of the female connector housing 5.

To install the thus constructed connector 1 to a place where waterdrops are likely to fall down inside the interior of an automobile or the like, the connector 1 is disposed so that the electrical cable outlet 39 of the female connector housing 5 faces downward and the electrical cables 13 extend downward. By disposing the connector 1 in the aforementioned manner, the connector 1 is free from ingress of water even if waterdrops such as dew deposit on the connector 1, since the female connector housing main body 25 of the connector 1 is made completely watertight by the cover member 21. Further, while the connector 1 has openings such as the electrical cable outlet 39 of the female connector housing 5 and the electrical cable outlets 32 of the male connector housing 9 at the lower portions thereof, there is no possibility of naturally falling waterdrops entering into the connector 1 from below. Therefore, the connector 1 can prevent waterdrops falling down thereon from entering thereinto completely.

It should be noted that the outlets 39, 32 for the electrical cables 13, 31 preferably face perpendicularly downward since the outlets 39, 33 facing downward contributes to preventing entrance of waterdrops into the connector 1 from below. However, even if the connector 1 is installed so that the outlets 39, 32 do not face perpendicularly downward, but obliquely downward, the advantage of preventing ingress of waterdrops can be provided.

Figure 4:
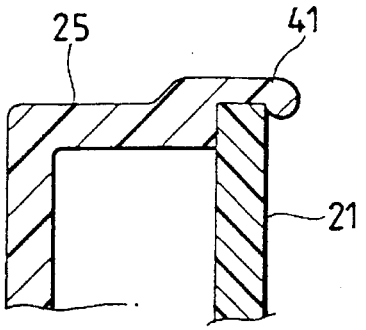
FIG. 4 is a partially sectional view of a female connector housing.

While watertightness is ensured by causing the female connector housing main body 25 to be in pressure contact with the cover member 21 in the aforementioned construction, an overhang 41 for slightly covering the peripheral portion of the cover member 21 may be provided on the female connector housing 5 as shown in FIG. 4 in order to improve watertightness. Such overhang 41 is preferably provided over the entire portion of the female connector housing 5 that the female connector housing comes in pressure contact with the cover member 21. Even if a gap is present at the pressure contact portion between the female connector housing main body 25 and the cover member 21 for some reason, the overhang 41 serves to cover such gap, thereby allowing watertightness to be maintained.

While it is preferable that the insertion portion 17 and the electrical cable outlet 39 of the female connector housing 5 as well as the electrical cable outlets 32 of the male connector housing 9 face perpendicularly downward as in the aforementioned embodiment, these components 17, 39, 32 may also face obliquely downward. In such a case, these components 17, 39, 32 may be oriented either in the same direction or in different directions.

Figure 5:
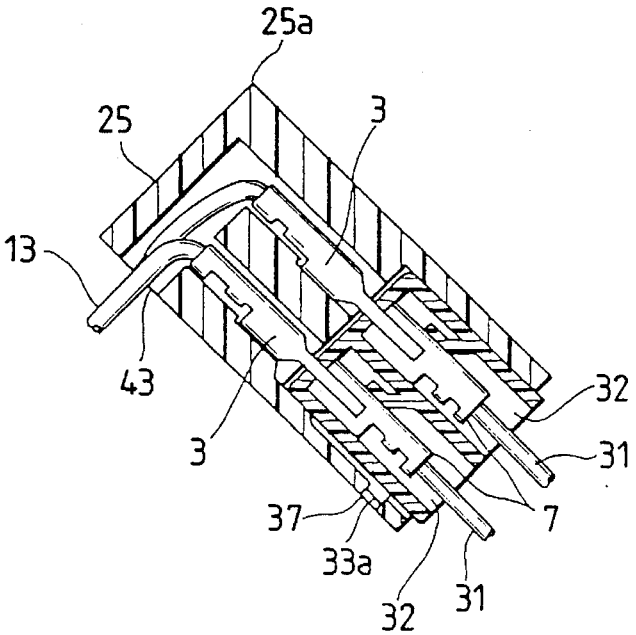
FIG. 5 is a partially sectional view of a connector, which is a second embodiment of the invention.
Figure 6:
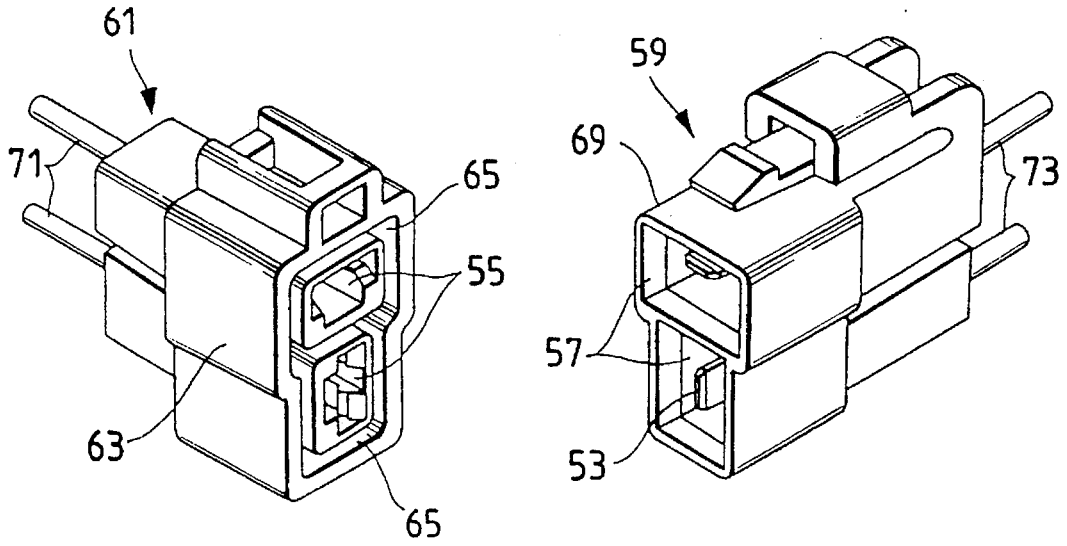
FIG. 6 PRIOR ART
FIG. 6 is an exploded perspective view of a conventional connector.
Figure 7:
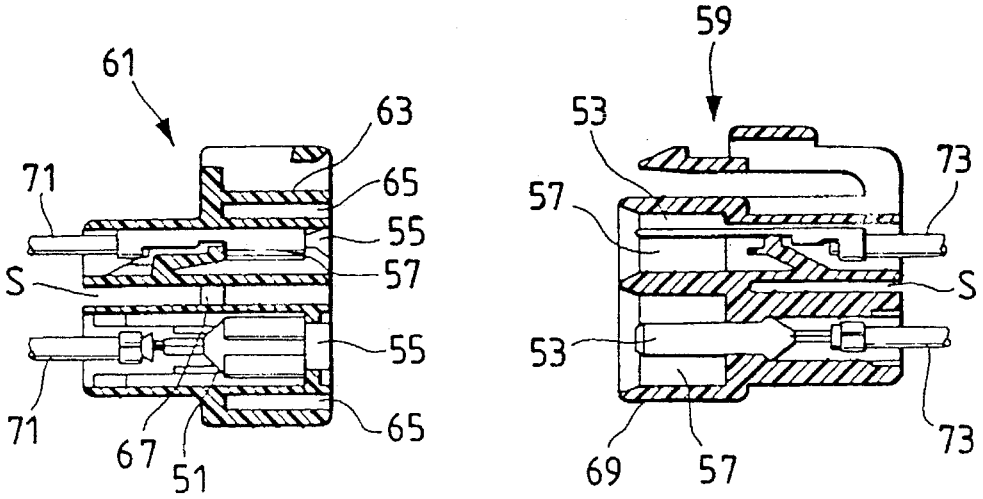
FIG. 7 PRIOR ART
FIG. 7 is a sectional view of the conventional connector.

For example, even if a connector is of the same rectangular shape as the aforementioned embodiment, the direction in which the insertion portion 17 of the female connector housing 5 is opened may become orthogonal to the direction in which an electrical cable outlet 43 of the female connector housing is opened as in a second embodiment shown in FIG. 5. The second embodiment shown in FIG. 5 is distinguished from the first embodiment only in that the position of the electrical cable outlet 43 of the female connector housing 5 is different. In the second embodiment, the insertion portion 17 and the electrical cable outlet 43 come to face obliquely downward if the connector is installed with a corner 25*a* of the female connector housing 5 as the vertex. Therefore, watertightness can be exhibited.

The angle of intersection between the directions of the openings in the second embodiment is not limited to 90°, but may be an acute angle or an obtuse angle.

While examples in which the connectors are used in an automobile have been described in the aforementioned embodiments, the connector of the invention may be used outdoors where raindrops and waterdrops fall down only from above, since the connector is watertight against waterdrops falling down from above.

As described above, according to the present invention, not only the female connector housing 5 is closed by the cover member 21, but also the opening of the male connector housing insertion recess formed in the female connector housing 5 of the connector 1 faces downward when installed, and both the female connector housing 5 and the male connector housing 9 have the outlets for the electrical cables connected to the terminals 39 and 32 respectively, on the side that faces downward when installed. Therefore, even if waterdrops fall down from above, the waterdrops can in no way enter into the connector, which in turn prevents electric corrosion due to leakage of current at the male and female terminals with certainty. Therefore, even in a position where waterdrops fall down, such as a position under where condensation takes place as a result of air conditioning or the like within the interior of an automobile, the electrical cables can be connected under good watertightness over a long period of time.

In addition, ingress of water into the connector can be prevented, which means that the connector is made watertight without using any seal member such as rubber or packings, thereby preventing the connector structure from becoming complicated. Therefore, deposition of waterdrops to the connection terminals can be prevented with a simple construction, which in turn allows production of inexpensive connectors.

What is claimed is:

1. A dripproof connector comprising:

a female electrical connector housing having an insertion portion in which first terminals are disposed;

a cover member integrally formed with said female electrical connector housing for closing said female electrical connector housing, said cover member being allowed to be opened and closed; and a male electrical connector housing being inserted into said insertion portion of said female electrical connector housing and accommodating second terminals therein, said first and second terminals being connected to respective electrical cables;

wherein said insertion portion of said female electrical connector housing has an opening on a side facing a downward direction when said male electrical connector housing is inserted upwardly and substantially entirely into said female electrical connector housing;

both of said female electrical connector housing and said male electrical connector housing having an outlet for receiving at least one of said respective electrical cables, wherein said outlets are positioned on sides of said male and female electrical connector housings which face in said downward direction when said male electrical connector housing is inserted upwardly into said female electrical connector housing, and said outlet of said female electrical connector housing has an aperture located on the same side as said opening of said insertion portion; and said male electrical connector housing further comprises a flexible lock arm formed integrally with said male electrical connector housing, and said female electrical connector housing further comprises an engagement groove formed in said insertion portion, wherein said flexible lock arm is engaged within said engagement groove to retain said male electrical connector housing within said female electrical connector housing.

2. A dripproof connector according to claim 1, wherein said at least one of said respective electrical cables inside said female electrical connector housing is arranged so as to be U-shaped.

3. A dripproof connector according to claim 1, wherein said female electrical connector housing includes an overhang for covering a peripheral portion of said cover member.

4. A dripproof connector as claimed in claim 1, wherein said cover member includes at least one retaining projection for engaging with a retainment receiving portion of said female electrical connector housing, thereby sealing said cover member to said female electrical connector housing.

* * * * *